US006655747B2

(12) United States Patent
Young et al.

(10) Patent No.: US 6,655,747 B2
(45) Date of Patent: Dec. 2, 2003

(54) IN-LINE ROLLER SKATE WHEEL

(75) Inventors: Charles Young, Irvine, CA (US); Boyd Sutton, HB, CA (US)

(73) Assignee: Bravo Sports, Cypress, CA (US)

( * ) Notice: Subject to any disclaimer, the term of this patent is extended or adjusted under 35 U.S.C. 154(b) by 0 days.

(21) Appl. No.: 09/910,553

(22) Filed: Jul. 20, 2001

(65) Prior Publication Data

US 2003/0015908 A1 Jan. 23, 2003

(51) Int. Cl.[7] ..... A63C 17/22

(52) U.S. Cl. ..... 301/5.301; 301/5.307; 301/5.309

(58) Field of Search ..... 301/5.301, 5.306, 301/5.307, 5.309, 5.303, 64.701; 152/323; 280/11.221

(56) References Cited

U.S. PATENT DOCUMENTS 1,576,924 A 3/1926 Malloy
4,153,303 A * 5/1979 Tanner
5,312,844 A 5/1994 Gonsior et al.
5,478,140 A 12/1995 Racosky
5,567,019 A * 10/1996 Raza et al.
5,573,309 A 11/1996 Bekessy
5,641,365 A 6/1997 Peterson et al.
5,655,784 A 8/1997 Lee
5,660,447 A 8/1997 Angelici
5,725,284 A 3/1998 Boyer
5,797,658 A * 8/1998 Larrucea ..... 301/5.301
5,823,634 A * 10/1998 Pozzobon ..... 301/5.301
5,829,757 A 11/1998 Chiang et al.
5,853,225 A 12/1998 Huang
6,033,612 A * 3/2000 Adams et al. ..... 264/258
6,085,815 A 7/2000 Piper et al.
6,102,091 A 8/2000 Peterson et al.
6,106,074 A 8/2000 Chang

* cited by examiner

*Primary Examiner*—Russell D. Stormer
(74) *Attorney, Agent, or Firm*—Fulwider Patton Lee & Utecht, LLP

(57) ABSTRACT

A polyurethane in-line roller skate wheel including a narrow hub mounting a polyurethane tire body having side walls curving axially inwardly from a major thickness to a minor thickness at the hub flange interface. In one embodiment, the hub is made of sections locked together by either adhesive or mechanical interlocks.

16 Claims, 6 Drawing Sheets

FIG. 1
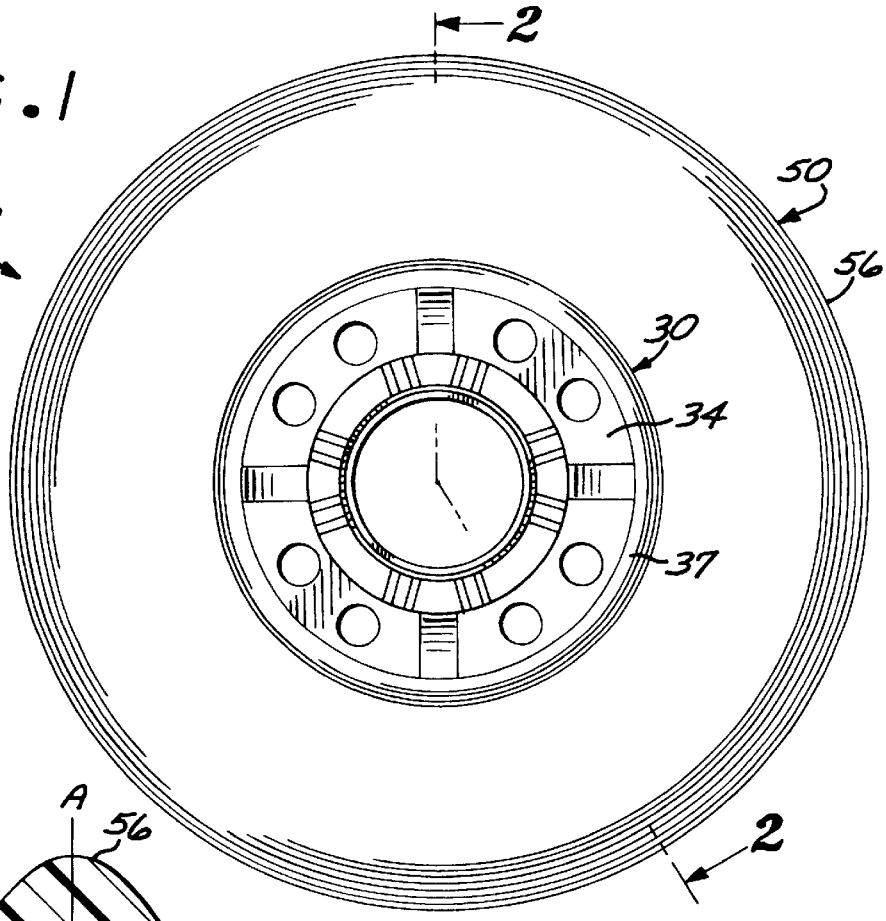
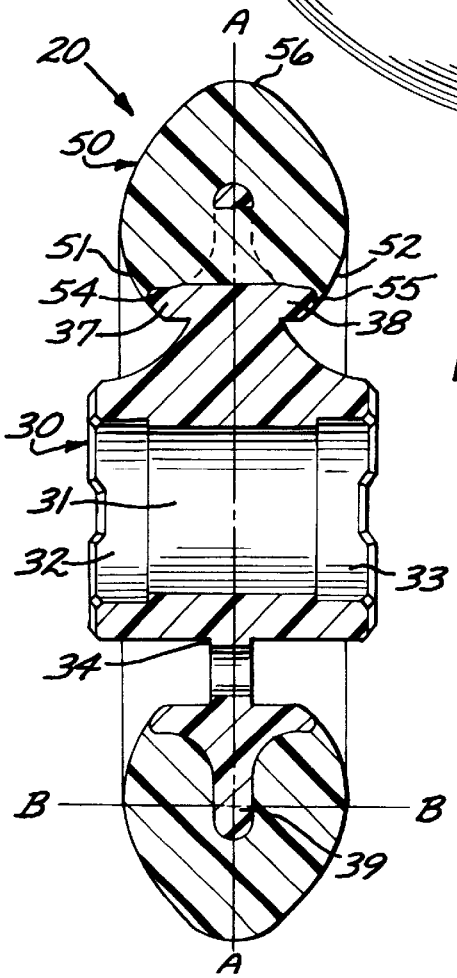
FIG. 2

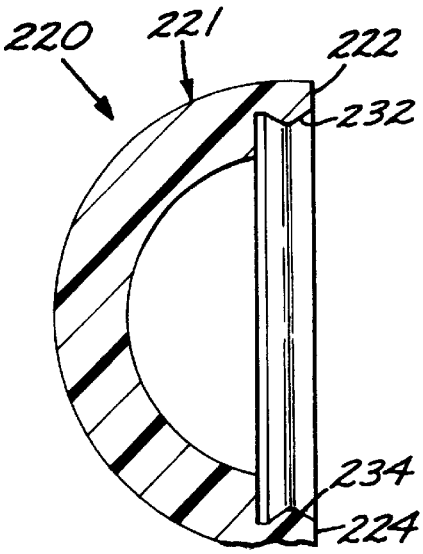
FIG. 16
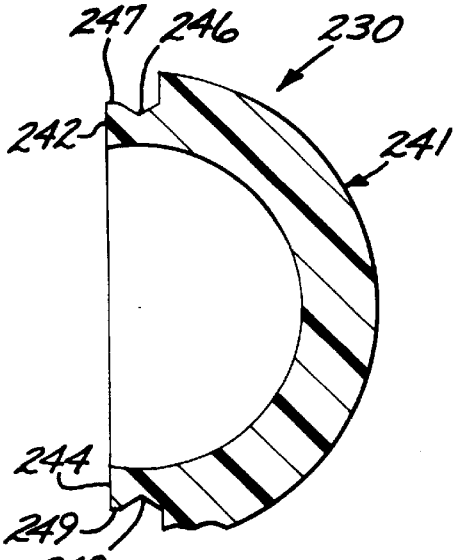
FIG. 17
FIG. 19
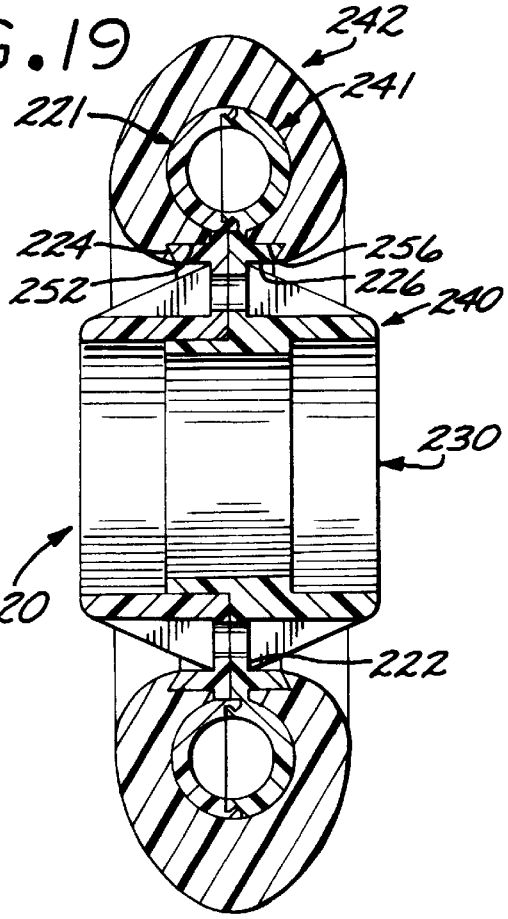
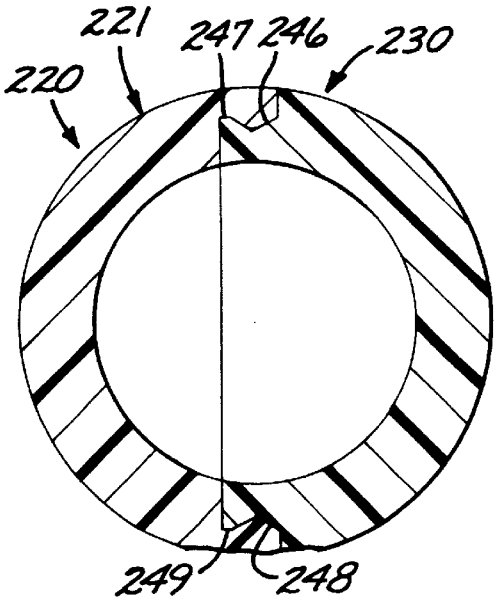
FIG. 18

IN-LINE ROLLER SKATE WHEEL

BACKGROUND OF THE INVENTION

The present invention relates to an in-line roller skate wheel and a method and apparatus for its manufacture. More specifically, the present invention relates to a wheel having a urethane hub and solid urethane tire of a unique shape and the mold configuration required to cast the tire.

In-line roller skates have been in existence since the $18^{th}$ century, the first recorded having been constructed by a Dutchman who wanted to practice ice skating during warm weather by mounting wooden spools under his boots and skating on dry land. Other generally unsuccessful attempts at in-line roller skates followed but then, in the $19^{th}$ century, the four-wheel skate with two pairs of wheels in a rectangular configuration was developed and took over the skating world. In-line skates were used very sparingly, mostly by ice skaters for warm-weather cross-training. In the early 1980's, a pair of in-line skates was created and the concept greatly improved upon by a pair of ice hockey players who mounted polyurethane wheels under ice skating boots and, due to the vastly improved performance provided by these skates, the sport of in-line skating mushroomed. Along with increased popularity came the demand for even more improvements in performance and durability.

Today's in-line skaters include racers, roller hockey players, serious ice hockey players looking for a cross-training device, stunt skaters, and casual users who only desire exercise and a smooth ride. Manufacturers have developed wheels of various profiles and hardness values to enhance sliding, gripping, maneuverability, speed, comfort and durability depending on the user's desire and skill level. Large diameter wheels with minimal tire flexing to reduce rolling resistance are generally used when speed is desired. Smaller diameter wheels with shock absorbing properties are preferred for most recreational skating while those doing stunts such as rail slides require wheels of an even smaller diameter and high hardness value. Two popular types of wheels have emerged over the past two decades to meet these diverse needs, those containing pneumatic tires made by casting polyurethane around an annular bladder, and those with solid tires made by casting or injection molding polyurethane in the desired shape around a hard polyurethane or nylon hub.

Pneumatic tire designs have been proposed of a construction similar to automobile tires with a pneumatic bladder encapsulated in polyurethane. These wheels provide a cushioned ride and, containing less polyurethane, are generally lighter than a solid wheel. They provide good grip and shock absorbing properties and are very suited to use on uneven surfaces and when encountering rocks and other road hazards. Although these wheels are well suited to these applications, they are generally more complex and expensive than solid tire wheels. U.S. Pat. Nos. 5,641,365, 6,085,815 and 6,102,091 to Peterson et al assigned to the assignee of the instant application and U.S. Pat. No. 5,853,225 to Huang disclose wheels of this type.

Solid tires are generally constructed of solid polyurethane tire bodies molded about a hub. Diameter, profile and hardness are adjusted for the skater's needs. U.S. Pat. No. 5,312,844 to Gonsior et al discloses a wheel with a thermoplastic polyether type polyurethane which is injection molded unto the hub to form a tire which is the width of the tire support ring at the ring contact radius and curves axially inwardly and radially outward to the tread surface. This shape tire is lacking in flexibility and ability to grip the ground during fast maneuvers. U.S. Pat. No. 5,567,019 to Raza et al discloses a similar wheel also with an injection molded tire of thermoplastic polyether type polyurethane and similar shape. Again, this shape tire is lacking in flexibility and ability to grip the ground during fast maneuvers. The manufacturing process is also relatively expensive.

U.S. Pat. No. 5,573,309 to Bekessy describes a wheel with a tapered tire deflection controlling rim extending circumferentially about the tire receiving shoulder, with rim side walls extending radially outward from a wide base at the tire receiving shoulder to a narrow peripheral surface. A resilient tire engages the tire receiving shoulder and encases the tapered tire deflection controlling rim. The tire includes an annular high friction shoulder situated radially inward and axially outward of its ground engaging outer surface. Deflection of this tire is said to allow use of more sidewall tire material for better compression and, in cooperation with the annular shoulder on the tire, cause progressively more tire material to contact the support surface as the skater turns, the harder the turn, the more surface contact for maintaining control. One configuration of this tire has recessed braking dimples situated about its ground engaging surface and radially inward of the tread section. The recessed braking dimples create channels of non-contact intended to reduce frictional resistance to a sideways skid when the skater is coming to a stop by tipping the skates to a maximum angle and skidding sideways to a stop. Although providing a good compromise between speed and gripping ability, the profile of this wheel is not optimized for weight reduction.

U.S. Pat. No. 5,655,784 to Lee discloses a solid tire mounted on a light weight fiber-reinforced hub to reduce flex and attain greater speed. U.S. Pat. No. 5,725,284 to Boyer discloses a wheel constructed of a plurality of layers of material disposed concentrically about a hub with the hardest material being on the outermost layer. U.S. Pat. No. 5,829,757 to Chiang et al discloses an in-line skate wheel with materials of similar hardness but different coefficient-of-friction values on different portions of the tires surface. The braking portion of the tire contains a high coefficient-of-friction material while the normal skating surface includes a high proportion of the low coefficient-of-friction material. This is touted as allowing the skater to proportionally engage the braking surface and control braking by leaning into the wheel and changing the angle to increase braking action.

These wheels each provide specific benefits but are generally complex, difficult to manufacture, and not optimized for high speed competition such as roller hockey and racing. There exists the need for a lightweight skate wheel which will provide a fast, smooth ride with excellent maneuverability and durability but without the complexity and expense of producing multi-segmented or pneumatic tires. There is also need to provide a method and apparatus for casting a wheel using a simple one piece tire, cast from urethane, and allowing use of unique profiles to reduce weight and enhance performance for any desired skating conditions.

SUMMARY OF THE INVENTION

The present invention includes many aspects. In one aspect it is in the form of a sculptured lightweight narrow in-line skate wheel particularly suited for, but not limited to, roller hockey and racing. The wheel includes a relatively hard, lightweight urethane hub and a solid urethane tire body with reduced hardness relative to the hub. The hub is constructed with a narrow axial support flange to cause the body of the wheel to be formed at its radially inner extent with a correspondingly narrower tire body width tapered axially inwardly from the opposite sides to cooperate in providing a low moment of inertia. In one embodiment the tire body is configured with a narrow crown to cooperate with the low moment of inertia to facilitate shifting of the wheel quickly from a turning position inclined in one direction to a position inclined in the opposite direction.

In one embodiment, the lightweight hub is formed with a transverse, annular bearing housing with oppositely opening bearing glands for insertion of a pair of bearings to mount on a skate wheel axle. The hub projects radially outward from this bearing housing in the form of an annular support disk which carries the annular support flange. The tire is mounted on the annular support flanges and encases a stabilizer ring that projects radially outwardly from the support flange. The radial stabilizer ring projects radially outwardly to cooperate in forming a tall profile projecting radially outwardly into the tire body to provide support under the tread to decrease deflection and rolling resistance, thus providing greater straight-line speed. The radial stabilizer ring profile is relatively thin, allowing a greater amount of the softer tire material on the sidewalls, promoting increased grip and maneuverability.

In one embodiment the hub is sectioned into two axial flanking sections which join to form the hub itself. The annular support disk may be formed with an annular tube or shell configured with the lightening cavity. Such shell and/or hubs may be sectioned to provide for ease of fabrication in sections to be joined by a mechanical joint and/or adhesive.

In one aspect of the present invention, a urethane wheel is formed by a hub fitting is constructed of first and second annular sections forming a bearing housing and an annular lightening shell concentric about the housing, with the shell being formed of confronting half tube walls terminating in concentric confronting edges, the edges including interfitting tongue and grove joint, constructed to snap together.

The present invention contemplates a cost effective method for manufacturing the wheel. The method employs a mold having annular upper and lower mold sections and a back pin section. The lower mold section is formed with an annular mold cavity section defining a central annular lower hub cavity for receiving a hub formed with the annular support flanges of a predetermined axial width and an outer lower tire body cavity section. The upper mold section is constructed to mate with the lower mold section and cooperates therewith to form a tire body cavity section curving radially inwardly and axially outwardly from a tread crown to form a maximum tire body width greater than the predetermined axial width of such support flanges, the top cavity wall projecting radially inwardly and axially outwardly to terminate in an annular sprue wall. The tire body cavity section is constructed so the lower annular support flange of the hub sealingly engages the wall of such cavity section and the back pin is constructed with an annular sealing lip to form a seal against the upper annular support flange on such hub. The pin further forms a portion of the tire's profile, curving upwardly from the annular support flange to terminate in a back pin sprue wall spaced radially inwardly from and concentric with the upper mold section sprue wall to form an annular sprue inlet for receipt of prepolymers, curatives and pigment additives.

To form a wheel, a preformed hub is placed in the lower mold section, the upper mold section is then positioned on the lower mold section, and the back pin is engaged with the hub. Prepolymers, curatives and pigment additives which will interact to form a polyurethane are then introduced through the sprue inlet to fill the tire body cavity and surround and bond to the annular support flanges and tire support rim portions of the hub to cooperate in forming a wheel. The wheel is then removed from the mold and trimmed.

As will be apparent to those skilled in the art for the sectioned hubs the separate sections therein may be fabricated separately and joined together to complete the finished hubs for receipt of the urethane tire material to be molded therein.

Other features and advantages of the present invention will become apparent from the following detailed description, taken in conjunction with the accompanying drawings, which illustrate, by way of example, the features of the invention.

BRIEF DESCRIPTION OF THE DRAWINGS

FIG. 1 is a side view of the wheel of the present invention;

FIG. 2 is a cross-sectional view taken along line 2—2 of FIG. 1;

FIGS. 16 and 17 are cross-sectional views of first and second annular tubular shell sections of a fourth embodiment of the wheel of the present invention;

FIG. 18 is a cross-sectional view showing the annular tubular shell sections of FIGS. 16 and 17 joined together; and FIG. 19 is a diametrical sectional view in reduced scale showing shell sections of FIG. 18 incorporated in a hub with a tire body mounted thereon.

DETAILED DESCRIPTION OF THE PREFERRED EMBODIMENT

Figure 3:
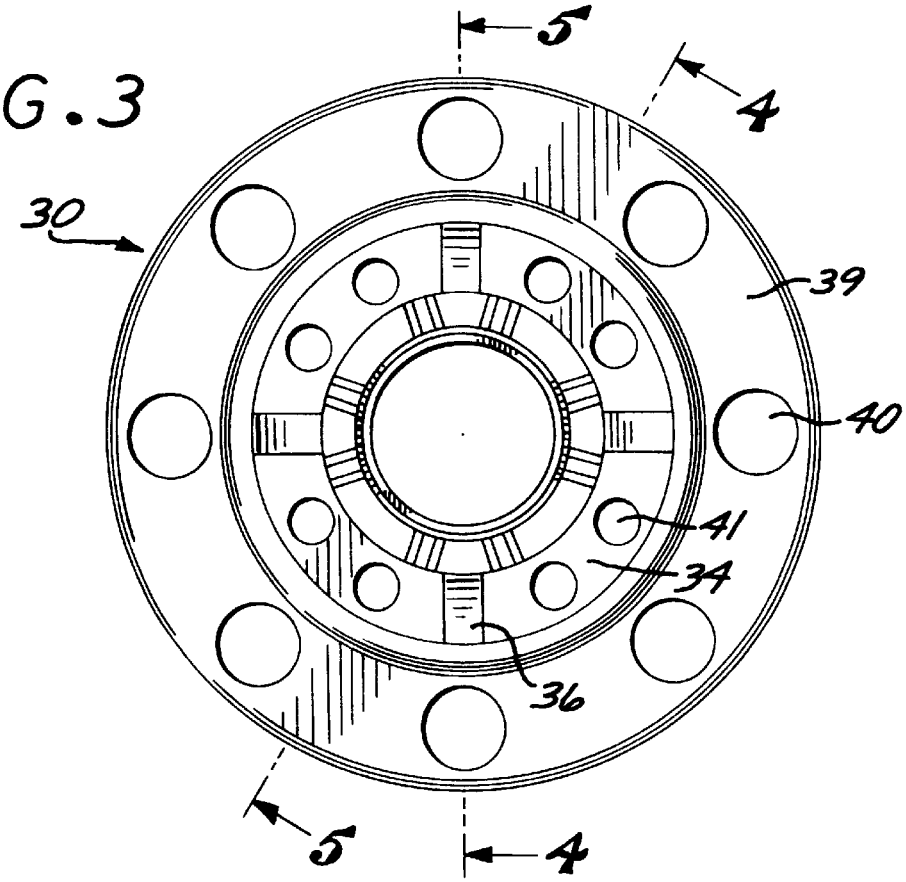
FIG. 3 is a side view of a hub included in the wheel shown in FIG. 1.

Performance is a key requirement for in-line skaters, especially those engaged in high speed competitions such as roller hockey and racing. Manufacturers have developed wheels of various profiles and hardness values to enhance sliding, gripping, maneuverability, speed, comfort and durability depending on the user's desire and skill level. It has been determined that large diameter wheels with minimal tire flexing to reduce rolling resistance are superior when speed is desired. Recreational skaters generally prefer smaller diameter wheels with shock absorbing properties while those doing stunts such as rail slides prefer wheels of an even smaller diameter and high hardness value. Two general types of wheels have emerged over the past two decades to meet these diverse needs, those containing pneumatic tires made by casting urethane around an annular bladder, and those with solid tires made by casting or injection molding urethane in the desired shape around a hard urethane or nylon hub. To optimize speed and maneuverability, a large diameter, lightweight, firm wheel with the capability for flexibility to engage more sidewall material while maneuvering is desirable. The present invention provides such a tire and a cost effective method for its manufacture.

Referring to FIGS. 1 and 2, the in-line roller skate wheel 20 of the prevent invention is of the two-piece construction including, generally, a hub 30 and a solid tire body 50. The hub 30 is formed with a cylindrical bearing housing 31 including oppositely opening bearing glands 32 and 33 for insertion of a standard set of bearings to mount the wheel on an axle. Projecting radially outwardly from the bearing housing 31, an annular stabilizer disk 34 supports a pair of annular support flanges 37 and 38 projecting in the opposite axial directions to form respective radially outwardly facing support surfaces. Such annular support flanges 37 and 38 cooperate with the annular stabilizer disk 34 in forming a tire body support that is advantageously narrow in axial cross section. The annular stabilizer disk 34 projects radially outwardly beyond the annular support flanges 37 and 38 to form a radial stabilizer ring 39 which cooperates to provide radial, circumferential, and axial support and stability to the tire body 50 during skating maneuvers. Such ring is formed with through axial anchoring openings in the form of bores 40 spaced equidistant thereabout. As seen in FIG. 2, the annular stabilizer disk 34, annular support flanges 37 and 38, and radial stabilizer ring 39 cooperate to form a generally cruciform shape in transverse cross section.

Referring still to FIG. 2, the urethane tire body 50 is formed with radially inwardly facing flanking bearing surfaces defining beads 54 and 55 that rest on the radially outwardly facing surfaces of the respective annular support flanges 37 and 38 and the urethane material can be seen to encapsulate the radial stabilizer ring 39 and fill the through-bores 40 to solidly anchor the tire body 50 to the hub 30. The short axial length of the annular support flanges 37 and 38 and relatively large diameter of the radial stabilizer ring 39 causes the tire body 50 to be formed with a narrow rounded central tread area 56 and the side walls to then angle radially inwardly and axially outwardly to a bulbous major width at line B—B from where such walls curve radially and axially inwardly toward one another defining the transition wall sections 51 and 52. The exterior contour of such tire in the axial cross section then cooperates in forming a shape simulating that of the profile of the glass portion protruding from the metal socket of a Christmas tree light bulb. This profile allows the skater to more quickly transition from one side of the wheel 20 to the other, increasing responsiveness. The narrower cross section of the tire body, and short axial length of the annular support flanges 37 and 38 causing the decreased-in-width cross section radially inwardly from the major diameter B—B, serve to provide for a lightweight polyurethane tire body 50. It will be appreciated that in some embodiments of the present invention the disk 34 may project radially outwardly to the diameter of the respective flanges 37 and 38.

Figure 4:
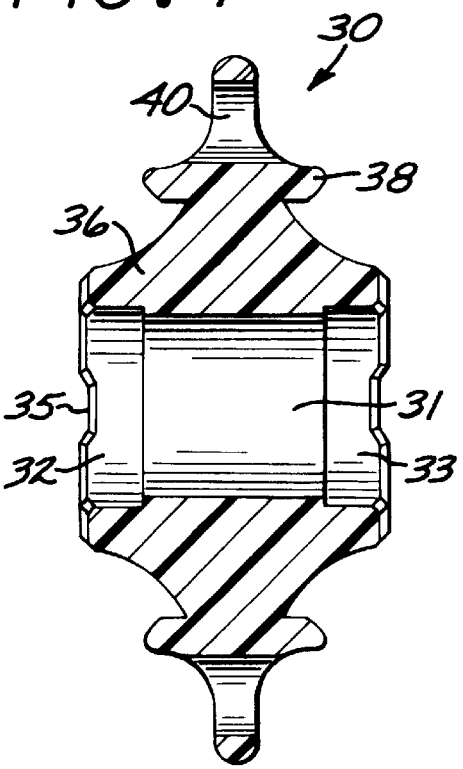
FIG. 4 is a cross-sectional view taken along line 4—4 of FIG. 3.
Figure 5:
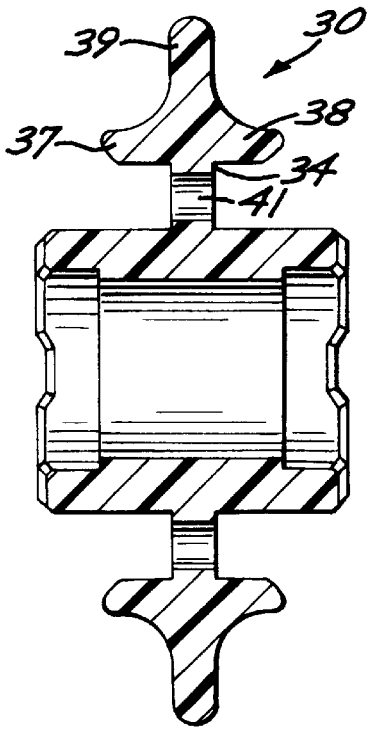
FIG. 5 is a cross-sectional view taken along line 5—5 of FIG. 3.

Referring to FIGS. 3–5, the hub is formed with radial stiffening webs 36 spaced at 90 degree increments on opposing axially outwardly facing surfaces of the annular stabilizer disk 34 radially inwardly of the respective annular support flanges 37 and 38. The edges of such stiffening webs 36 curve axially inwardly and radially outwardly from the axially outward edge of the bearing housing 31 to blend into the annular stabilizer disk 34 at its juncture with the annular support flanges 37 and 38. The stiffening webs provide support to the annular stabilizer disk 34 and allow a thinner, lighter disk than would otherwise be able to support the stresses created by skating.

The hub 30 is formed as a single piece to simplify wheel manufacture and incorporates several weight saving features as can be appreciated in FIGS. 3–5. Sculpturing 35 on the axially outward faces of the bearing glands 32 and 33 reduces weight and provides the added benefit of exposing a larger portion of the bearings to air to improve cooling. The disk 34 is formed with a plurality of annular, transverse through lightening bores 41 are disposed in an annular arrangement on a diameter smaller than that of the flanges 37 and 38.

The bearing housing 31, annular stabilizer disk 34, radial stabilizer ring 39, and tire body 50 are centered on the wheel centerline A—A shown in FIG. 2. The bearing glands 32 and 33 are axially opposing and equidistant from the centerline as are the stiffening webs 36 and the annular support flanges 37 and 38. An alternate embodiment, not shown, can be formed with the radial stabilizer ring 39 advantageously offset from this centerline to provide different degrees of stiffness on the two sides of the wheel for special maneuvering capability.

In the preferred embodiment shown in FIGS. 1–5, the hub 30 is formed with an outer radial diameter of approximately 2.150 inches at the distal radial edges of the radial stabilizer ring 39. The annular support flanges 37 and 38 have an overall axial width of approximately 0.560 inches and are formed such the outer radial diameter of their radially outwardly facing surface is approximately 1.500 inches at their axially outermost point. The bearing glands 32 and 33 are formed with an inner radial diameter of approximately 0.627 inches to accept a relatively small diameter bearing (not shown) known in the trade as a micro bearing. The bearing glands 32 and 33 may also be formed with an inner radial diameter of approximately 0.866 inches to accept the larger standard bearing. The tire body 50 is formed with an outer radial diameter of approximately 2.835 inches and curves radially inwardly and axially outwardly from the outer diameter to an axial width of approximately 0.850 inches and then curves radially and axially inwardly to an axial width of approximately 0.560 inches where it joins the annular support flanges 37 and 38. The maximum axial width, shown by the line B—B in FIG. 2, is located approximately 0.97 inches radially outward from the radial centerline of the hub. It will be appreciated that the wheel of the present invention is ideally about 0.850 inches wide but many vary in maximum width up to substantially less than the traditional width of 0.965 inches, typically 0.900 inches or less.

Figure 6:
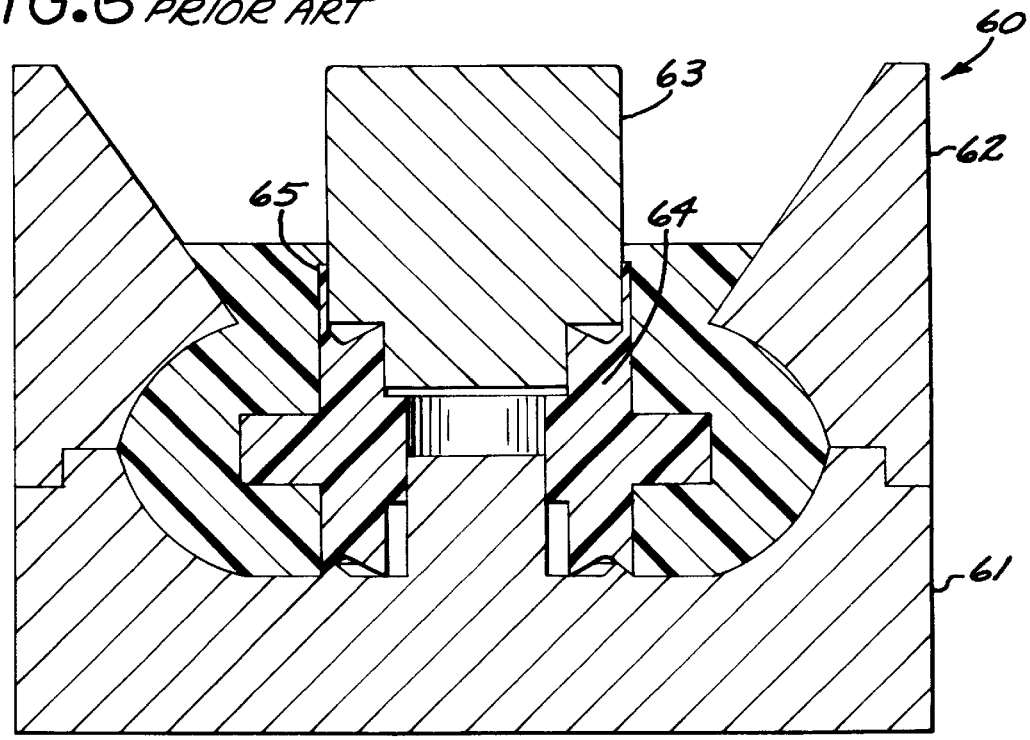
FIG.6 PRIOR ART
FIG. 6 is a cross-sectional view of a prior art tire casting mold.
Figure 7:
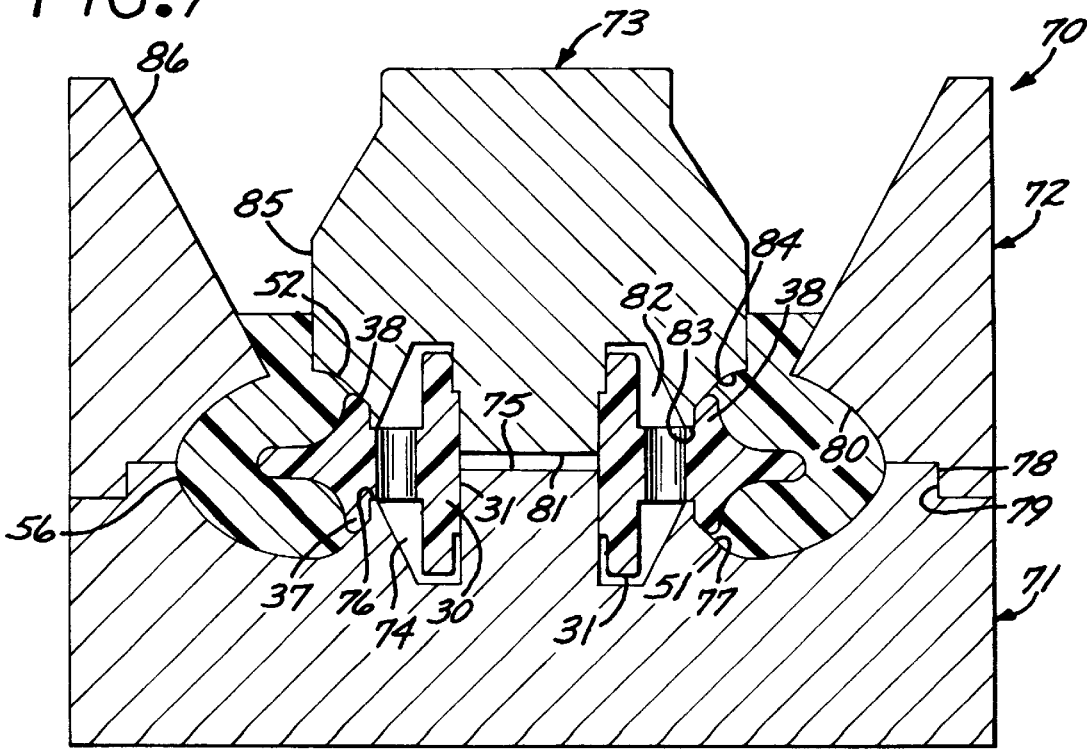
FIG. 7 is a cross-sectional view of the tire casting mold utilized to make the wheel of the present invention.
Figure 8:
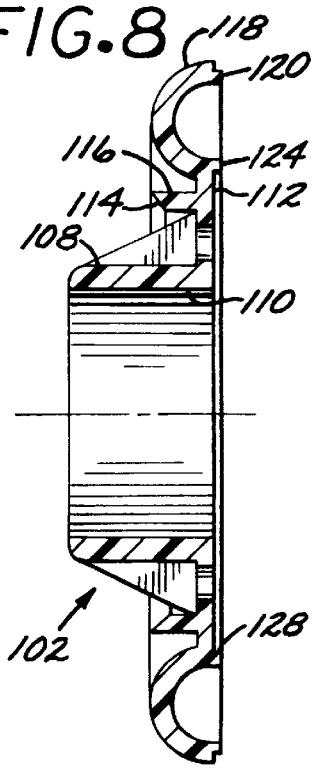
FIGS. 8 and 9 are diametrical sectional views of first and second hub sections of a second embodiment of the wheel of the present invention.
Figure 9:
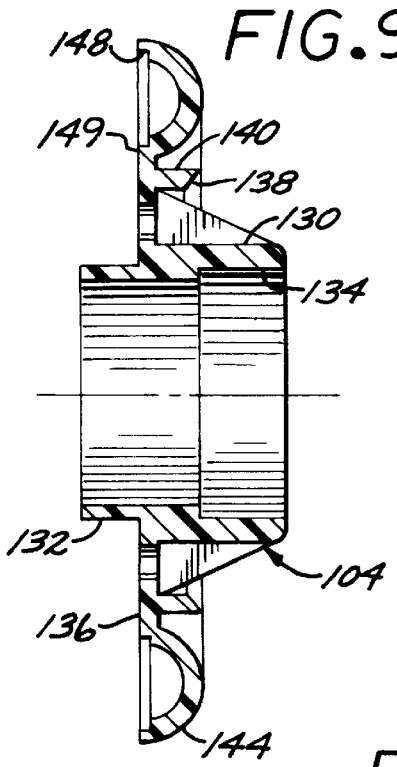

A method for manufacturing the wheel of the present invention uses a three piece mold as shown in FIG. 7. For comparison, a prior art method for manufacturing a wheel is shown in FIG. 6 to demonstrate the advantages of the present method.

Referring now to FIG. 6, one sees an example of a prior art urethane casting mold 60. The lower mold section 61 is formed with an annular upwardly opening cavity and is positioned horizontally to accept a conventional cylindrical hub 64 in a manner similar to the present invention. The annular upper mold section 62 is then positioned atop the lower mold section 61 and cooperates with it to form an annular cavity in the desired shape a tire to be casted. An axial back pin 63 is then inserted into the top end of hub 64 and more specifically into an extended skirt 65 on the hub 64 to block flow of liquid urethane into the hub spokes and bearing housing during the casting process. It will be appreciated by one skilled in the art that the back pin 63 forms no part of the cavity defining the tire profile. After casting, the wheel is removed from the mold 60 and the hub skirt 65 and excess urethane must be trimmed.

Referring to FIG. 7, a mold 70 is shown that may be used to make the wheel 20 of the present invention. In describing the wheel 20, hub 30, tire body 50, and mold 70, the term lower will refer to the lower one-half axial side of the wheel and, the term upper to the upper one-half axial side of the wheel. As can be seen, the mold 70 may include, generally, a lower mold section 71, an upper mold section 72, and a central back pin 73. The lower mold section 71 is formed with an upwardly opening cavity configured to cooperate with a downwardly opening annular cavity formed by the combination of the upper mold section 72 and back pin 73 to define a major portion of the desired tire body profile.

The lower mole section 71 is formed with an upwardly opening central annular cavity well 74 configured to complementally receive the axially lower portion of the bearing housing 31 and surrounding an axial centering post 75 configured to be complementally received in telescopical relationship in the lower end of such bearing housing. The radial outer walls forming the central annular cavity well 74 slope axially upwardly radially and outwardly to form an annular sealing lip 76 configured to be engaged telescopically in fluid light relationship on the radially inner side of the annular support flange 37. The lower mold section 71 is then formed with a tire body wall concentric about the well 74 which curves radially outwardly and axially downwardly from the annular sealing lip 76 to form a narrowing section 77 forming the shape of the narrowing transition wall section 51 of the tire body and configured to have the axial edge of the flange 37 nested thereagainst. The lower mold section 71 then slopes axially downwardly to a maximum tire diameter and then slopes axially upwardly and radially outwardly to complete the form of one half the tire body terminating at a central separation line disposed at the crown of the tire body.

As will be appreciated by those skilled in the art, the upper and lower mold sections 72 and 71 are configured to register together. To this end, the lower mold section is formed with a raised rib 78 and an annular radially outwardly opening notch for receipt of a downwardly projecting annular ring 79 formed about the periphery of the upper mold section 72.

The upper mold section 72 is donut shaped and is configured with an arcuate axially downwardly and inwardly facing curved annular cavity surface 80 configured to cooperate with the radially distal portion of the lower cavity section to form the opposite tread walls of the tire body.

The back pin 73 is configured with a downwardly projecting, axial, stepped centering post 81 confronting the post 75 and configured to be complementally received in the upper end of the bearing housing 31 of the hub 30 to center such pin therein. Such back pin is formed with a downwardly opening annular well 82 configured to complementally receive the axially upper portion of the bearing housing 31. The back pin 73 is further formed with a downwardly projecting annular, concentric sealing lip 83 for sealing against the radially interior side and axial end of the annular support flange 38 of the hub 30 to seal against escape of liquid polyurethane. Such back pin is then formed with a tire body wall which slopes radially outwardly and axially upwardly from the annular sealing lip 83 to form an annular cavity narrowing section 84 configured to form the shape of the narrowing transition wall section 52 of the tire body.

Such back pin is formed with a major diameter annular wall 85 is configured to cooperate with the inner annular wall 86 of the upper mold section 72 to form an annular sprue to accommodate the pouring of prepolymers, curatives and pigment additives during the manufacturing process.

It will be appreciated that the back pin 73 is designed to provide a cost effective method of wheel 20 manufacture. In the prior art, as shown in FIG. 6, the axial width of the urethane tire is constant as it approaches the hub 64. Conventionally, the back pin 63 merely acts as a plug and necessitates a cylindrical skirt 65 on the hub to seal liquid urethane from flowing into the hub and bearing housing. The opposite walls of tire body 50 of the present invention curves, arially and radially inwardly in the narrowing section 77 in to meet the hub 30. As shown in FIG. 7, the design of the present invention back pin is unique in that the annular sealing lip 83 forms an effective seal against the hub 30 without the need for a skirt. This back pin design is further unique in that it also forms a portion of the urethane tire profile that tucks in on the back side of the wheel.

To manufacture an in-line roller skate wheel using the techniques and designs of the present invention, a mold 70 of the desired wheel profile is first selected. The appropriate hub 30 is then placed in the lower mold section 71 with the centering post 75 complementally received in the lower end of the hub's bearing housing 31 and the hub's annular support flange 37 resting squarely on the annular sealing lip 76 of the lower mold section 71. The upper mold section 72 is then placed on the lower mold section 71 such that their surfaces are flush with one another and the raised rib 78 and annular ring 79 are in registration around the entire perimeter. The back pin 73 is then placed on the hub 30 such that the back pin centering post 81 is complementally received in the upper end of the hub bearing housing 31 and the back pin annular sealing lip 83 engages the upper annular support flange 38 around its entire perimeter. The major diameter of the upper mold section annular wall 85 and back pin inner annular wall 86 now cooperate to form an annular sprue inlet. Prepolymers, curatives and pigment additives which will interact to form a polyurethane are then introduced through the sprue inlet to fill the tire body cavity formed by the mold 70 and surround and bond to the radially outward surface of the annular support flanges 37 and 38 to cooperate in forming a wheel. One polyurethane suitable for this application is sold by B. F. Goodrich under the trade designation ESTALOC®. In some applications it may be desirable to incorporate reinforcing fibers such as those included in grade No. 59300. The back pin 73 and upper mold section 72 are then removed, the wheel 20 is removed from the lower mold section 71, and excess urethane is trimmed from the wheel. The wheel is then ready for use on a skate.

In use, a set, generally four, of the light weight, low inertia wheels of the present invention is mounted on each of a pair of in-line roller skates. The performance advantages provided by these wheels will be appreciated by reviewing maneuvers a skater advances through in a typical competition and examining how the wheel's features cooperate to improve the skater's competitive edge. Initially, the skater must accelerate. In this phase, the thin tire body profile and curving provide the tire opposite side walls radially inwardly toward one another to meet the respective ends of the short annular support flanges presents the benefit of reduced mass to form low inertia wheels. This allows rapid angular acceleration of the wheels themselves and the light weight of the skates to allow for quick strides, both contributing to rapid buildup of the skater's speed as the skater then transitions into the high speed phase straight line speed becomes of paramount importance. The tall profile of the radial stabilizer ring causes it to project well into the tire body material to provide greater support to the tread area to decrease deflection and consequent rolling resistance. The skater will now benefit from the relatively large light weight diameter wheel to further enhance speed. In addition to high speed, a competition such as ice hockey also requires great maneuverability on the part of the skater. Quick turns and rapid deceleration and acceleration are critical to success. The relatively thin profile of the radial stabilizer ring provides for a significantly greater amount of the softer tire body on the opposite sides thereof to promote increased function and grip in the sidewall area for improved maneuverability and braking during turning maneuvers. The low inertia of the wheels also improves deceleration allowing them to stop spinning more quickly. As the competition goes on, it will be appreciated that the light weight skates require less expenditure of energy by the skater as the mass to be accelerated and decelerated in each stride is reduced This allows better sustained performance and more enjoyment on the part on the skater.

Referring to FIGS. 8–11, a second embodiment of the wheel of the present invention includes, generally, first and second cylindrical hub sections 102 and 104 which, when joined, form an axial hub 106. The hub section 102 is formed with an axial cylindrical female tube 108 configured with a cylindrical bearing gland 110. Radiating outwardly from such female tube 108 is an annular support disk section 112 supporting an annular load bearing support flange 114 projecting axially to the left (FIG. 8) and formed with a radially outwardly facing annular support seat 116. The disk section 112 is formed at its radially outer extremity with an annular half tube shell section 118 to cooperate in defining a lightening cavity. The shell section 118, is, in cross section, in the form of an arcuate half cylinder and opens to the right as viewed in FIG. 8 and is formed with a pair of radially spaced apart concentric edges undercut externally to form oppositely facing circumferential notches having respective projecting circumferential lips defining tongues 120 and 124. The hub section 102 is formed on its interior face with an annular interface configured with a circular recess 128 having the same diameter as the outer diameter of the interior for a tongue 124.

The second hub section 104 is configured with an axial bearing tube section 130 formed with a male tube section 132 for telescopical receipt into the right end of the socket 110 and to define interiorly on the right-hand extremity a bearing gland 134. An annular support disk section 136 radiates outwardly from the tube 132 to be sandwiched against the disk section 112 and is formed medially with an annular load bearing flange 138 projecting axially to the right (FIG. 9) having a radially outwardly facing annular seat 140 aligned axially with the seat 116. The disk section 136 is formed at its radially outer extremity with a half tube arcuate shell section 144 constructed to cooperate with the shell section 118 to form an annular, tube shaped shell. The wall of such shell section 144 terminates in concentric edges which are undercut internally to provide annular notches defining respective concentric grooves 148 and 149 configured to receive in interfitting relationship the respective tongues 120 and 124 for nesting therein. (FIG. 10) The undercut defining the groove 149 (FIG. 9) is of the same diameter as the diameter of the recess 112 (FIG. 8) to thus form a raised boss to be registered in such recess on assembly (FIG. 10).

Figure 10:
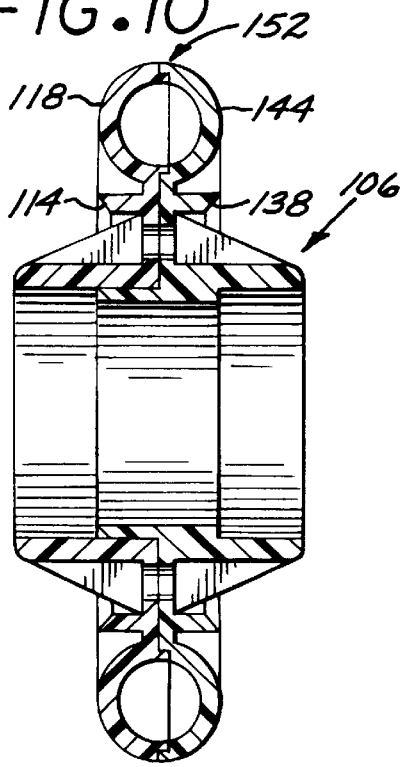
FIG. 10 is a diametrical sectional view of the sections shown in FIGS. 8 and 9 joined together.
Figure 11:
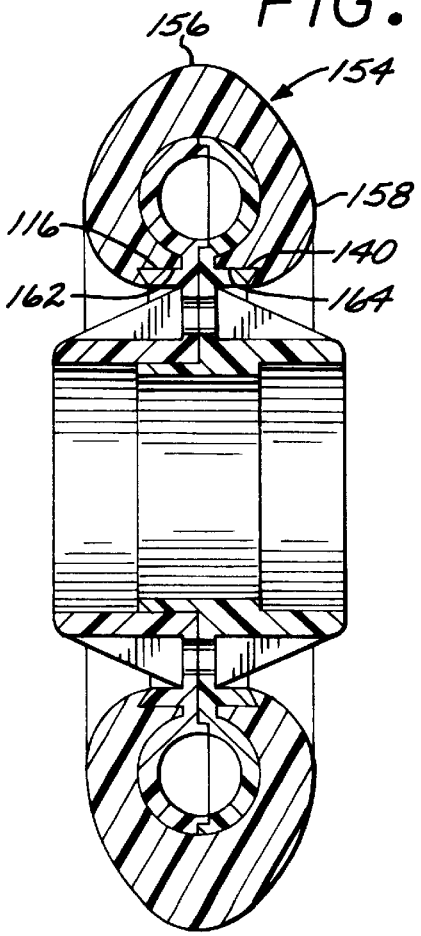
FIG. 11 is a diametrical sectional view similar to FIG. 10 but showing a tire body mounted on the hub.
Figure 12:
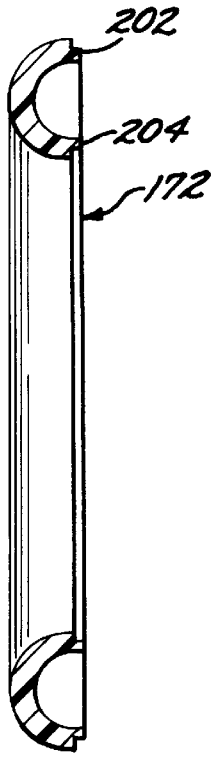
FIGS. 12 and 13 are diametrical sectional views of first and second hub sections of a third embodiment of the wheel of the present invention.
Figure 13:
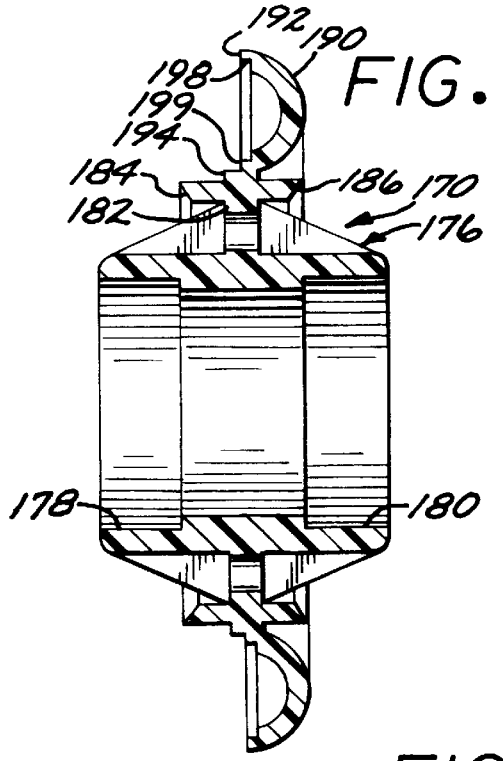

In assembly, it will be appreciated that the axial sections 102 and 104 may be molded separately and may be joined by telescoping the male tube 132 into the female socket 110 as shown in FIG. 10 thus causing the raised boss defined by the undercut 149 in the hub section 104 to be nested in the recess 112 (FIG. 10) and the respective tongues 120 and 124 to be received in sliding relationship within the respective grooves 148 and 149. In practice, such tongues are received in friction fit within such grooves and may be further secured therein by adhesive or other bonding material which is well known to those skilled in the art.

The hub, when assembled and joined, can thus be casted with a tire body 154 thereabout in a manner similar to that shown for the wheel depicted in FIG. 7. The tire body 154 is constructed with a narrow crown 156 defining a tread surface and walls which slope radially inwardly while angling axially outwardly to a major thickness 158 from where they curve or slope radially inwardly axially toward one another to join at the opposite outer extremities of the respective support flanges 114 and 138. The wheel body 154 thus forms beads 162 and 164 which nest on the respective seats 116 and 140. The construction thus affords a narrow lightweight wheel body which has a relatively narrow width and includes an annular void in the shell sections 118 and 144 to provide a relatively low mass to thus facilitate high performance skating.

Referring to FIGS. 12–15 a third embodiment of the wheel apparatus of the present invention is similar to that shown in FIGS. 8–11 and includes hub sections generally designated 170 and 172. The hub section 170 is formed with an integral cylindrical bearing housing generally designated 176 configured with axially outwardly opening bearing glands 178 and 180. Radiating outwardly from the tube 176 is a support disk 182 which mounts on the opposite sides thereof respective support flanges 184 and 186. Formed at the radially outer extent of such support disk is an annular half tube shell section 190 which opens to the left as viewed in FIG. 13 and terminates in concentric edges which are undercut interiorly to form circumferential lips 192 and 194 spaced radially to form interior groove 198 and 199.

Figure 14:
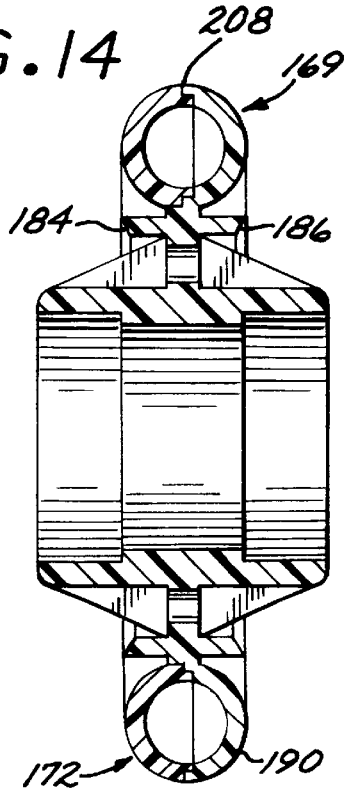
FIG. 14 is a diametrical sectional view showing the sections of FIGS. 12 and 13 joined together.
Figure 15:
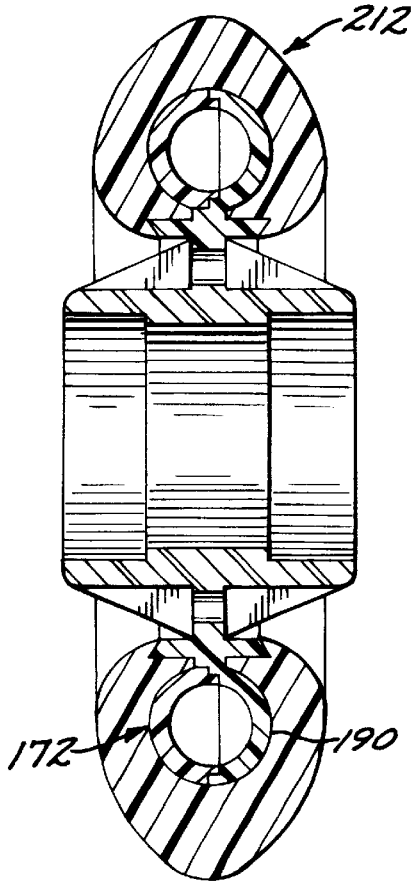
FIG. 15 is a diametrical sectional view of the hub shown in FIG. 14 but with a tire body mounted thereon.

The second hub section 172 is also annularly shaped in the form of a half annular tube opening to the right and formed with radially spaced apart concentric edges undercut exteriorly to leave annular lips defining tongues 202 and 204 configured to be complementally received in the respective annular grooves 198 and 199 (FIG. 14).

When joined together as shown in FIG. 14, such hub 169 forms a medial joint generally designated 208 which may be bonded by any well-known adhesive. The hub may then be placed in a mold like that shown in FIG. 7 and the tire body, designated 212, molded there around.

A fourth embodiment of the wheel of the present invention (FIGS. 16–19) is similar to that shown in FIGS. 8–11 except the two annular hub sections, generally designated 220 and 230, are joined together to form hub fitting 240 by means of a mechanical snap joint rather than just friction and/or adhesives. Such hub sections cooperate to form an annular disk 222 and annular support flanges 224 and 226 which combine to form an axial width less than the preferred maximum width of the tire body 242 so that the opposite side walls of such body curve axially and radially inwardly from the major tire thickness to the opposite ends of such flanges. Hub section 220 is formed at its radially outer extremity with an annular half tube shell section 221 which opens to the right as viewed in FIG. 16 forming edges which are undercut interiorly to define concentric annular lips 222 and 225 formed on their confronting surfaces with respective V-shaped tongues 232 and 234.

The section 230 is configured with a half tube annular shell 241 terminating in concentric edges defining circumferential lips 242 and 244 which are undercut externally to form respective opposite outwardly facing concentric V-shaped grooves 246 and 248 configured to compliment the shape of such of the respective tongues 232 and 234. It will be appreciated that when the hub sections 220 and 230 are assembled, they may be mated together in a fashion similar to that for the hub sections shown in FIGS. 8 through 11. As the sections are brought together, the respective half tube shell sections 221 and 230 will flex slightly to allow the respective V-shaped tongues 232 and 234 to cam over the respective retainer ribs 247 and 249 to then snap into place in the respective groove 246 and 248 thus retained securely therein by the mechanical interlock. It will be appreciated that the arrangement of the tongue and groove joint structure can be configured such that there is an interference fit to provide for a mechanical lock. If desired adhesives may be added but, in some instances, the mechanical interference between the retainer ribs 247 and 249 and the tongues 232 and 234 will be such that, when constrained within the body of the tire 242 will afford sufficient locking force to maintain the hub sections 220 and 230 locked together under normal use.

It will be appreciated that the tire body 242 may be casted about the distal portion of the disk 222 in a fastening fashion similar to that described above to provide for a maximum width of the tire body of about 0.850 inches or possibly slightly more and then curve radially and axially inwardly as shown in FIG. 19 to the opposite ends of the respective support flanges 224 and 226 such that the inwardly facing support surfaces 252 and 256 nest on such flanges thus affording adequate support and making full benefit of the diminished tire body mass radially interior of the major width of such wheel body.

It will be appreciated that for the wheel shown in FIGS. 16 through 19, the hub sections 220 and 230 have broad application and have utility in providing secure structure and lightening benefits for polyurethane wheels of many different configurations and widths. One particular utility is in the fabrication of the above-described narrow wheels described above.

From the foregoing, it will be apparent that the narrow profile of the present invention provides a lightweight wheel that presents high performance characteristics while exhibiting a relatively low moment of inertia. The wheel has a pronounced pointed profile allowing for the greatest flex of the sidewalls and a small but firm contact patch in the center of the tire. These features promote high speed and maneuverability on tiled surfaces and the wheel is well suited for indoor hockey. Hockey requires quick turns and stops where a high function grip with the under surface is required. In this regard as used herein the term quick-turn or high performance quick turn in-line roller skate wheel is intended to mere an in-line wheel having favorable gripping capabilities as would be deemed important in a hockey wheel or racing wheel. It will however be appreciated that with minor alterations of the mold a slightly wider profile can be cast for indoor hockey on Roll-On™ or maple wood flooring. A full wrap profile can also be formed to place a greater amount of urethane on the tire to maximize durability for outdoor use. Other enhancements could include shims placed on the sides of the tire support rim to increase the rigidity of the wheel, decreasing the sidewall grip but increasing wheel speed.

It will therefore be appreciated by those skilled in the art of in-line skate wheels that the invention as illustrated and described herein is the preferred embodiment and that changes in shape, materials, tire profile and tread design may be made without departing from the spirit and scope of the invention. It is also appreciated by those skilled in the art of skate wheels that the designs and methods of this invention could be applied to the production of scooter wheels. Accordingly, it is not intended that the invention be limited except by the appended claims.

What is claimed is:

1. A narrow light weight in-line quick turn roller skate wheel comprising:

a relatively soft cast molded urethane tire body formed with an annular tread crown having radially inwardly and outwardly sloping side walls radiating axially outwardly to a maximum body width of 0.850 inches or less and then formed with a narrowing body section configured by such walls sloping radially and axially inwardly toward one another to a predetermined axial width, the body further formed with radially inwardly facing flanking beads;

a hub including an annular housing formed with annular, radially outwardly facing support flanges supporting the respective beads and configured with a combined axial width corresponding with said predetermined width; and said hub being formed with a radial disk embedded in the body to facilitate anchoring thereof to such hub.

2. The wheel of claim 1 wherein:

said opposite narrowing walls curve radially inwardly and axially inwardly toward one another.

3. The wheel of claim 1 wherein:

said tire body is formed with said maximum body width less than 0.800 inches.

4. The wheel of claim 1 wherein:

said support flanges define a load bearing surface; and said disk projects radially outwardly a distance from said load bearing surface to project at least to the radial center of said tire body.

5. The wheel of claim 1 wherein:

said tire body section is oval in transverse cross section.

6. The wheel of claim 1 wherein:

said tire body is Christmas tree bulb shaped in transverse cross section.

7. The wheel of claim 1 wherein:

the said predetermined axial width is 0.560 inches.

8. A narrow light weight quick turn in-line roller skate wheel comprising:

a urethane tire body formed with a tread crown having radially inwardly and outwardly sloping side walls radiating axially outwardly to a maximum body width of 0.850 inches or less and then formed with a narrowing body section configured by such walls sloping radially and axially inwardly toward one another at a selected angle to a predetermined axial width, the body further formed with radially inwardly facing flanking beads;

a hub including an annular housing formed with annular, radially outwardly facing support flanges supporting the respective said beads and configured with a combined axial width corresponding with said predetermined width, the support flanges terminating at the opposite axial ends angling radially and outwardly inwardly toward one another at said selected angle; and said hub being formed with a radial disk embedded in said body to facilitate anchoring thereof to such hub.

9. A narrow light weight in-line quick turn roller skate wheel comprising:

a cast molded urethane tire body formed with a radially outwardly disposed tread crown and side walls angling radially inwardly and axially outwardly to a maximum body width of 0.800 inches or less and then formed with a narrowing body section configured by such walls sloping radially and axially inwardly toward one another to a predetermined axial width, the body further formed with radially inwardly facing annular flanking beads;

a hub including a housing formed with annular, radially outwardly facing support flanges supporting the respective beads and configured with a combined axial width corresponding with said predetermined axial width; and said hub being formed with a radial disk embedded in the body to facilitate anchoring thereof to said hub.

10. The light weight in-line roller skate wheel of claim 9 wherein:

the disk is axially centered on such hub.

11. The narrow light weight quick turn in-line roller skate wheel of claim 9 wherein:

said hub is injection molded.

12. A narrow profile lightweight quick turn high performance quick turn in-line skate wheel comprising:

a relatively soft cast molded, annular urethane tire body formed with an annular narrow tread crown and having side walls tapering radially inwardly and axially outwardly away from one another to a major thickness of 0.800 inches or less and then tapering radially and axially inwardly toward one another for a selected distance and turning axially inwardly to form respective radially inwardly facing tire beads; and a relatively hard hub including a radially outwardly projecting weight bearing support disk embedded in said tire body to cooperate in supporting said tire body against axially flexing, said hub further formed on its axially opposite side with axially outwardly projecting annular support flanges having radially outwardly facing bead support surfaces engaging the respective said tire body beads whereby loads applied to said hub will cause said tire body to flex and grip the underlying support surface and, as said wheel is inclined from the vertical under load said support disk will cooperate in supporting said tire body against axial deflection.

13. A narrow light weight quick turn in-line roller skate wheel comprising:

a relatively soft cast molded tire body constructed of a mixture of polyurethane including prepolymers, curatives and pigment formed with a tread crown having radially inwardly and outwardly sloping side walls radiating axially outwardly to a maximum body width of 0.850 inches or less and then formed with a narrowing body section configured by such walls sloping radially and axially inwardly toward one another to a predetermined axial width, the body further formed with radially inwardly facing flanking beads;

a relatively hard hub including an annular housing formed with annular, radially outwardly facing support flanges supporting the respective said beads and configured with a combined axial width corresponding with said predetermined width; and said hub being formed with a radial disk embedded in said body to facilitate anchoring thereof to said hub whereby, when loaded, the hub and disk will cooperate to support the tire body while the body flexes under load to grip a support surface.

14. A narrow light weight in-line roller skate wheel comprising:

a urethane tire body formed with a tread crown having radially inwardly and outwardly sloping side walls radiating axially outwardly to a maximum body width of 0.850 inches or less and then formed with a narrowing body section configured by such walls sloping radially and axially inwardly toward one another to a predetermined axial width, the body further formed with radially inwardly facing flanking beads;

a hub including an annular housing formed with annular, radially outwardly facing support flanges supporting the respective beads and configured with a combined axial width corresponding with the predetermined width, the support flanges terminating at their opposite axial ends angling radially and axially toward one another at a selected angle and the tire body being formed with such side walls angling radially inwardly and axially toward one another at such selected angle; and the hub being formed with a radial disk embedded in the body to facilitate anchoring thereof to such hub.

15. The light weight in-line roller skate wheel of claim 14 wherein:

the predetermined axial width is 0.560 inches.

16. The light weight in-line roller skate wheel of claim 14 wherein:

the disk is formed with axial anchoring openings spaced annularly thereabout and receiving urethane from such tire body.

* * * * *